US006891512B2

(12) United States Patent
Chadwick

(10) Patent No.: US 6,891,512 B2
(45) Date of Patent: May 10, 2005

(54) ANTENNA

(75) Inventor: George G. Chadwick, Carbondale, CO (US)

(73) Assignee: Cocomo Mb Cojmmunications, Inc., Tokyo (JP)

( * ) Notice: Subject to any disclaimer, the term of this patent is extended or adjusted under 35 U.S.C. 154(b) by 0 days.

(21) Appl. No.: 10/412,371

(22) Filed: Apr. 11, 2003

(65) Prior Publication Data

US 2004/0201529 A1 Oct. 14, 2004

Related U.S. Application Data

(63) Continuation-in-part of application No. 09/724,535, filed on Nov. 27, 2000, now abandoned, and a continuation-in-part of application No. 10/160,747, filed on May 30, 2002, now Pat. No. 6,600,896.

(51) Int. Cl.[7] ..... H01Q 13/00; H01Q 1/32

(52) U.S. Cl. ..... 343/773; 343/713; 343/712

(58) Field of Search ..... 343/713, 773, 343/712, 711

(56) References Cited

U.S. PATENT DOCUMENTS

| | | | | |
|---|---|---|---|---|
| 2,368,663 A | | 2/1945 | Kandolan | |
| 3,787,865 A | | 1/1974 | MacDowell et al. | |
| 3,942,180 A | | 3/1976 | Rannou et al. | |
| 4,428,078 A | | 1/1984 | Kuo | |
| 4,698,639 A | | 10/1987 | Mead et al. | |
| 4,845,505 A | * | 7/1989 | Ohe et al. | 343/712 |
| 4,847,561 A | | 7/1989 | Soohoo | |
| 4,851,859 A | | 7/1989 | Rappaport | |
| 4,864,320 A | * | 9/1989 | Munson et al. | 343/833 |
| 5,230,085 A | | 7/1993 | Loposer | |
| 5,302,960 A | | 4/1994 | Boers | |
| 5,335,366 A | | 8/1994 | Daniel | |
| 5,373,304 A | | 12/1994 | Nolan et al. | |
| 5,526,005 A | | 6/1996 | Koo | |
| 5,557,287 A | | 9/1996 | Pottala et al. | |
| 5,608,416 A | * | 3/1997 | Champion et al. | 343/773 |
| 5,613,221 A | | 3/1997 | Hunt | |
| 5,694,137 A | | 12/1997 | Wood | |
| 5,696,861 A | | 12/1997 | Schimmeyer et al. | |
| 5,999,142 A | | 12/1999 | Jang | |
| 6,057,756 A | | 5/2000 | Engellenner | |
| 6,081,728 A | | 6/2000 | Stein et al. | |
| 6,095,820 A | | 8/2000 | Luxon et al. | |
| 6,097,340 A | | 8/2000 | Chang | |
| 6,151,354 A | | 11/2000 | Abbey | |
| 6,160,405 A | | 12/2000 | Needle et al. | |

FOREIGN PATENT DOCUMENTS

| | | |
|---|---|---|
| DE | 1 441 103 | 10/1968 |
| EP | 0 055 591 | 7/1982 |
| GB | 926599 | 12/1961 |
| GB | 1 532 010 | 11/1978 |
| WO | WO 97/44909 A | 11/1997 |
| WO | WO 01/54224 A1 | 7/2001 |

OTHER PUBLICATIONS

Chandra, Mouly M., et al., "Analytical Evaluation of Radiation Patterns of a Tacan Antenna", *Proceedings of the National Aerospace and Electronics Conference* (*NAECON*), Dayton OH *New York IEEE,* US vol. 1, Conf. 41, (May 22, 1989), 187–192.

* cited by examiner

*Primary Examiner*—James Vannucci
(74) *Attorney, Agent, or Firm*—Deborah A. Peacock; Peacock Myers & Adams PC

(57) ABSTRACT

An antenna system, particularly for vehicles. A discone-type antenna is preferably utilized for frequencies outside the vehicle. At various frequencies, either or both the antenna and the vehicle serve as exciters.

34 Claims, 17 Drawing Sheets

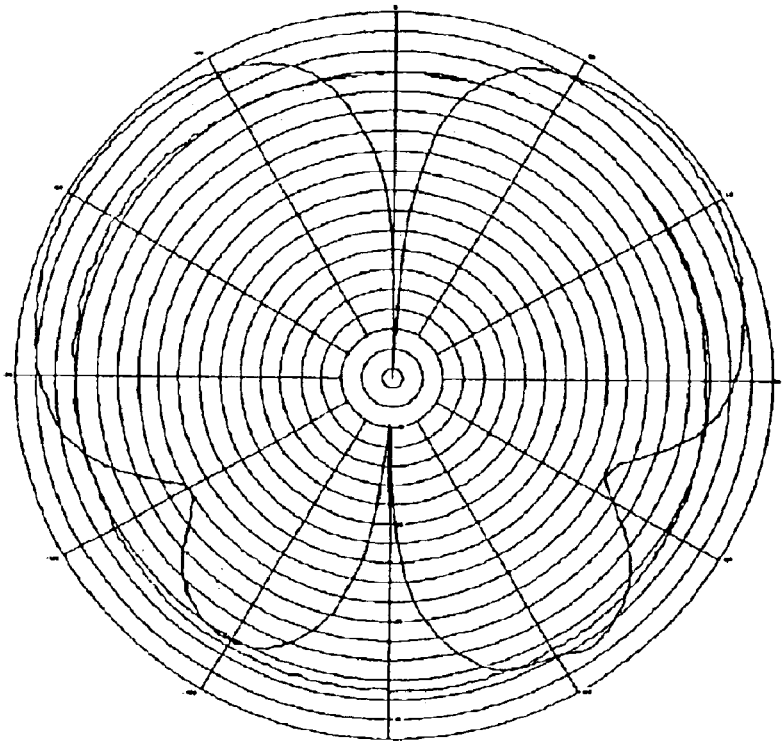
FIG 7 Azimuth and Elevation Pattern 800 MHz
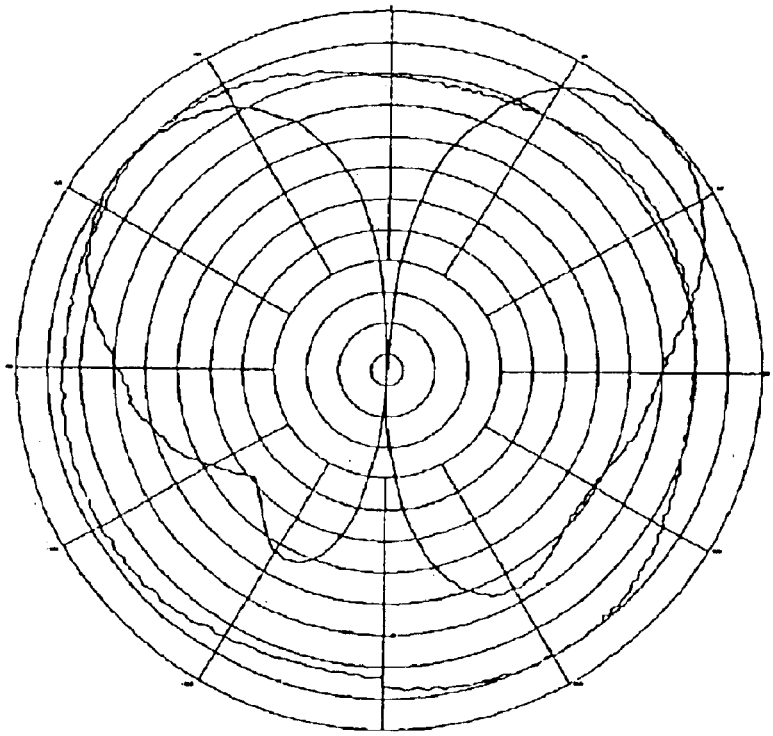
FIG 8 Azimuth and Elevation Pattern 900 MHz

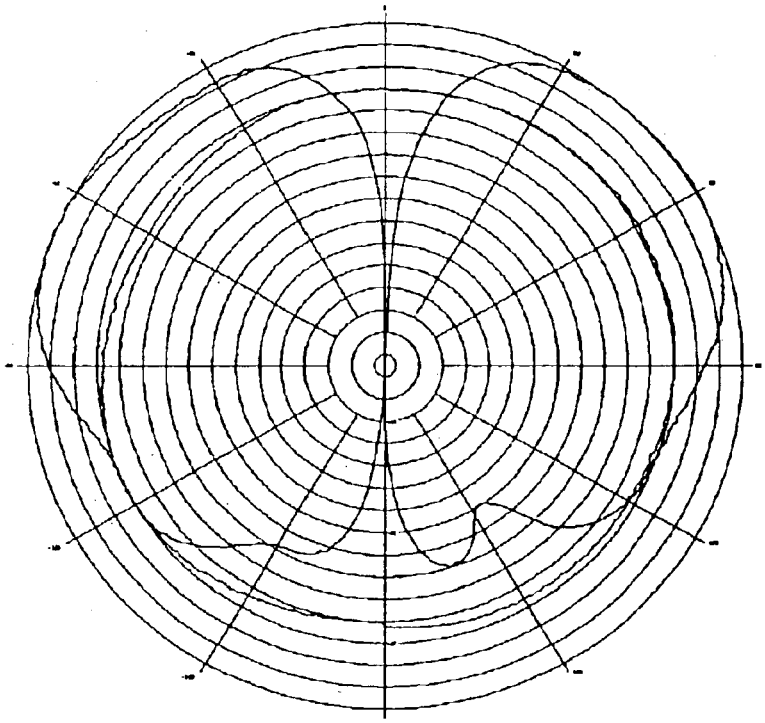
FIG 9 Azimuth and Elevation Pattern 1500 MHz
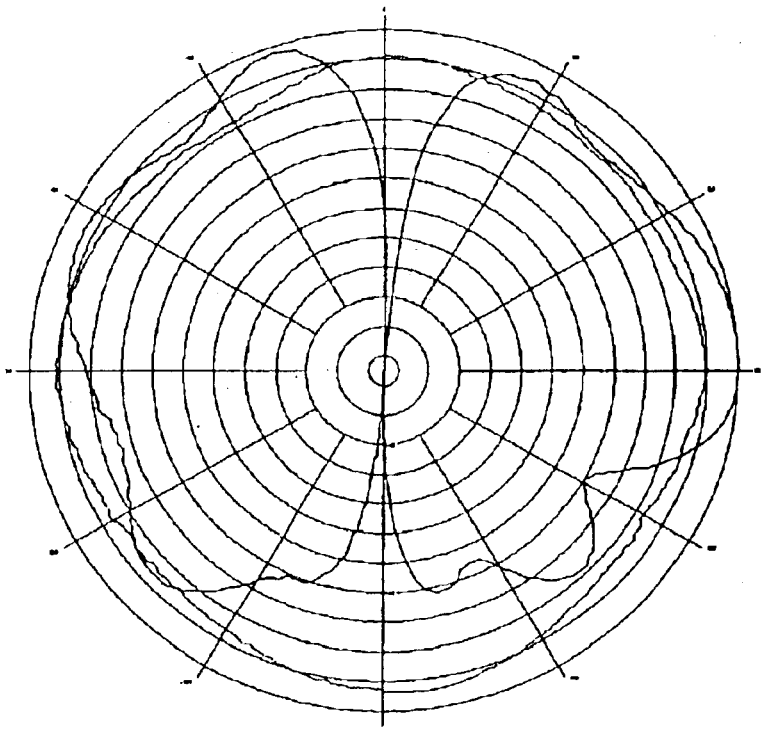
FIG 10 Azimuth and Elevation Pattern 1800 MHz

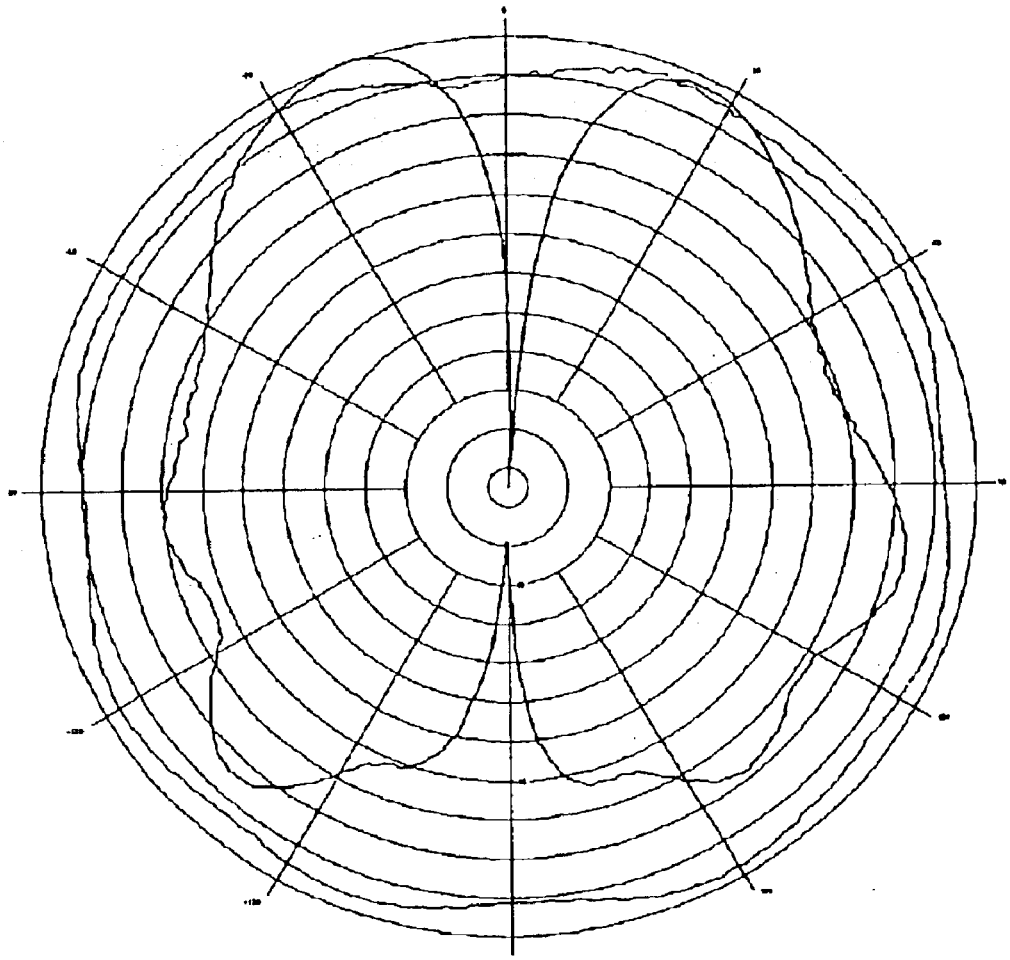
FIG 11 Azimuth and Elevation Pattern 1900 MHz

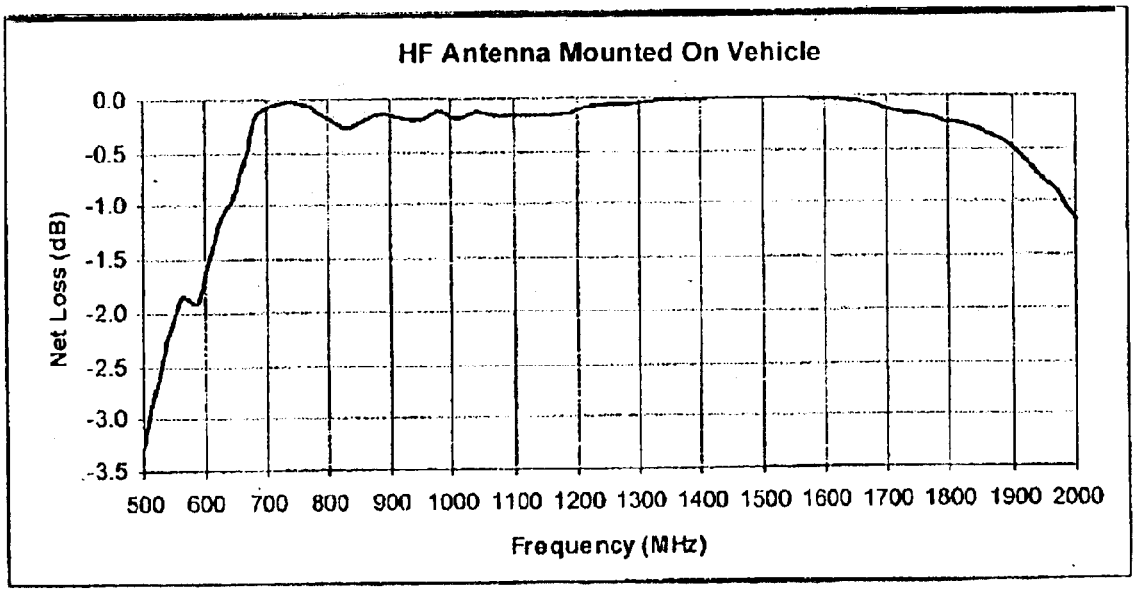
FIG12 Measured Return Loss
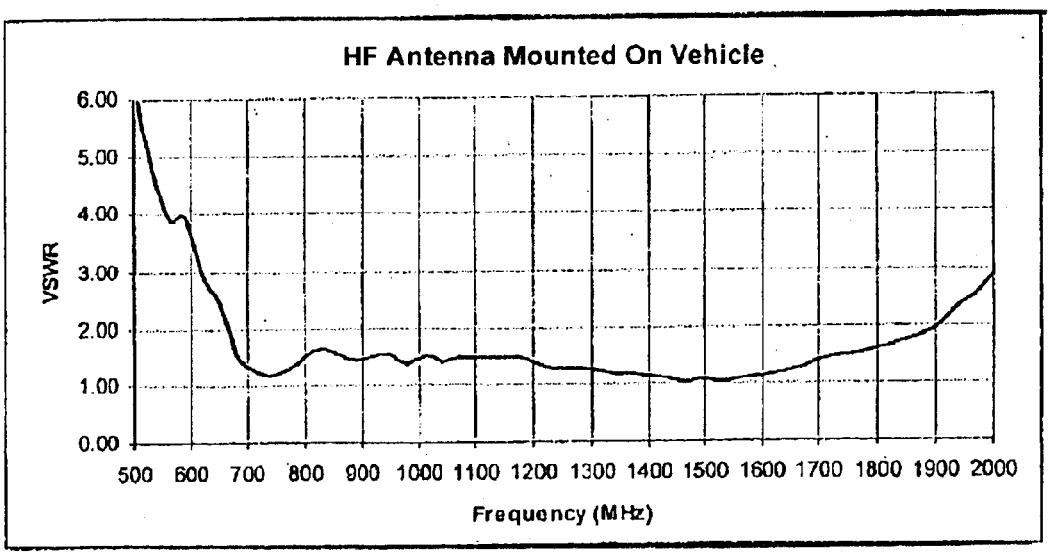
FIG13 Measured VSWR

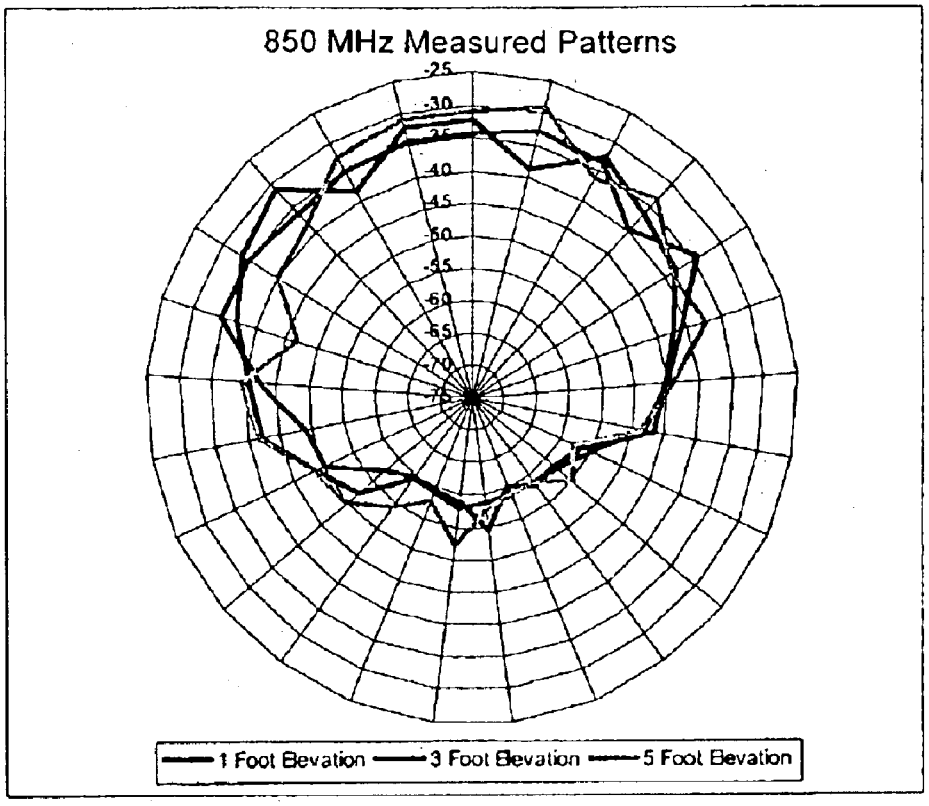
FIG 14 Patterns at 850 MHz
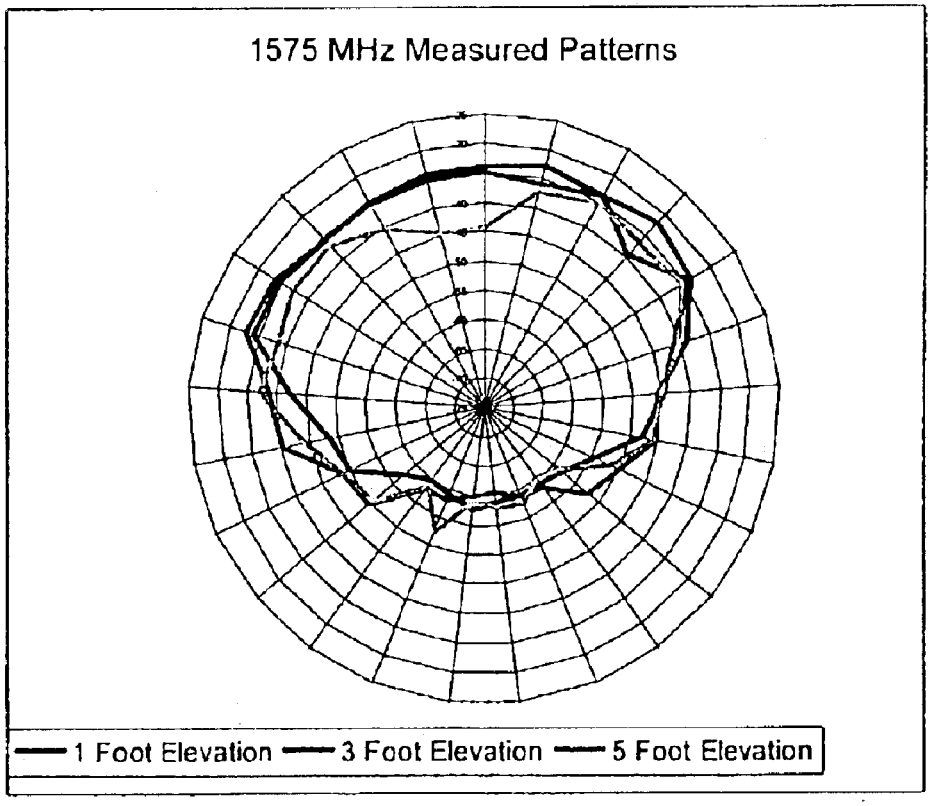
FIG 15 Patterns at 1575 MHz

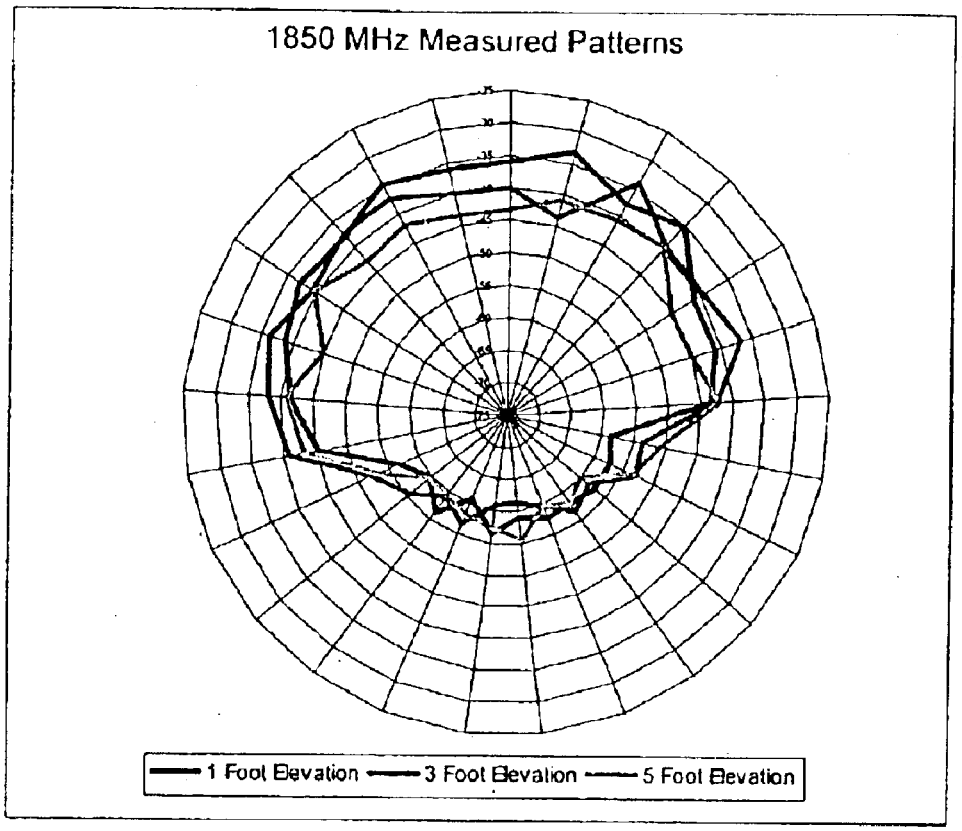
FIG 16 Patterns at 1850 MHz
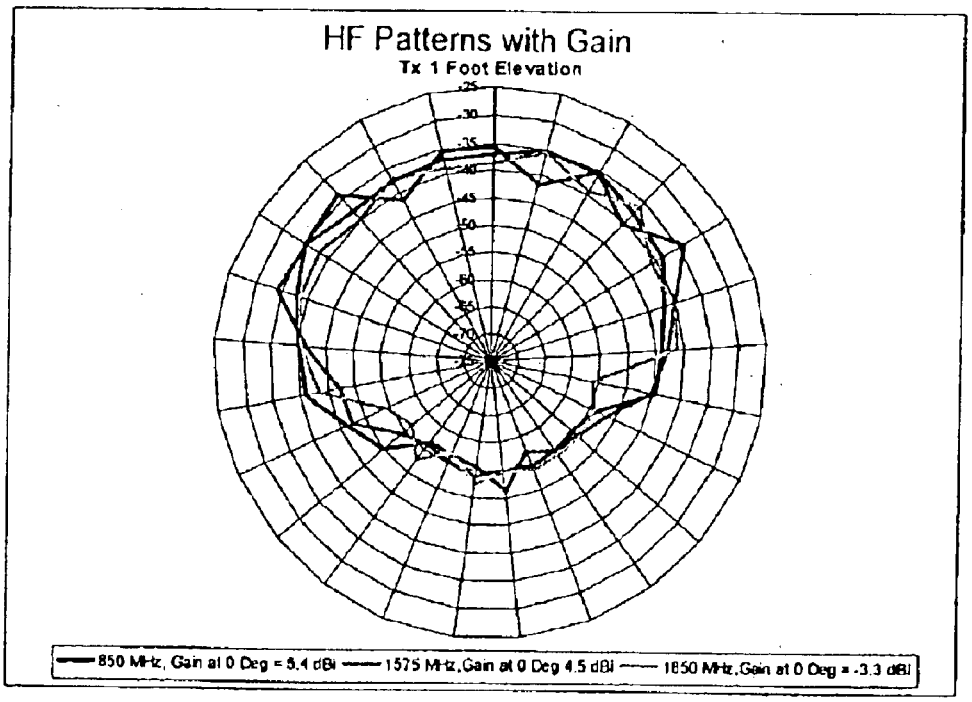
FIG 17 Measured Patterns with Gain

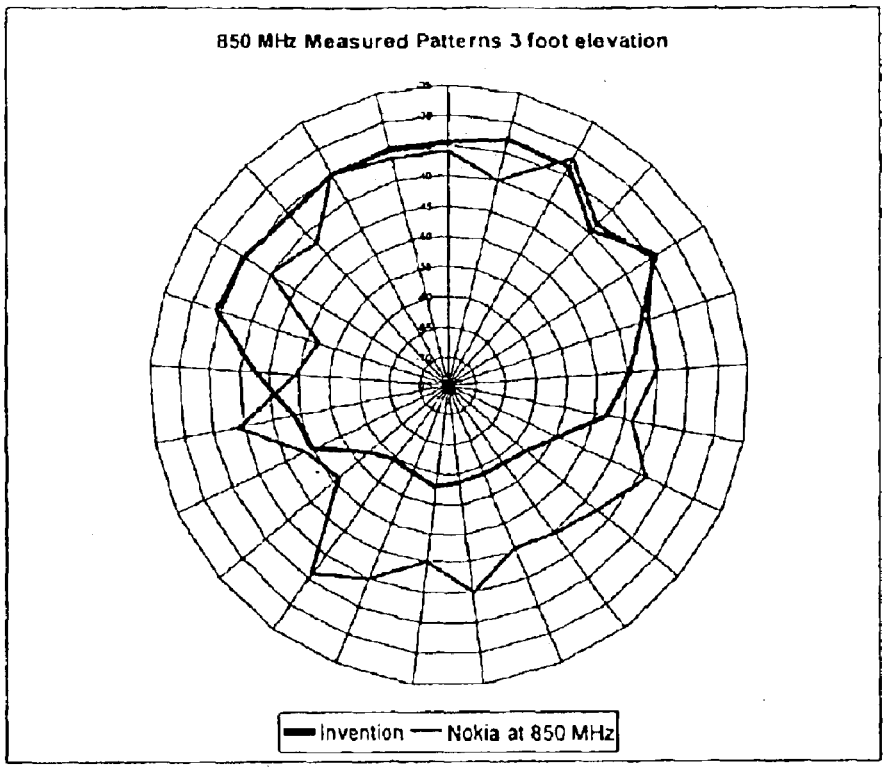
FIG 18 Data Comparison at 850 MHz
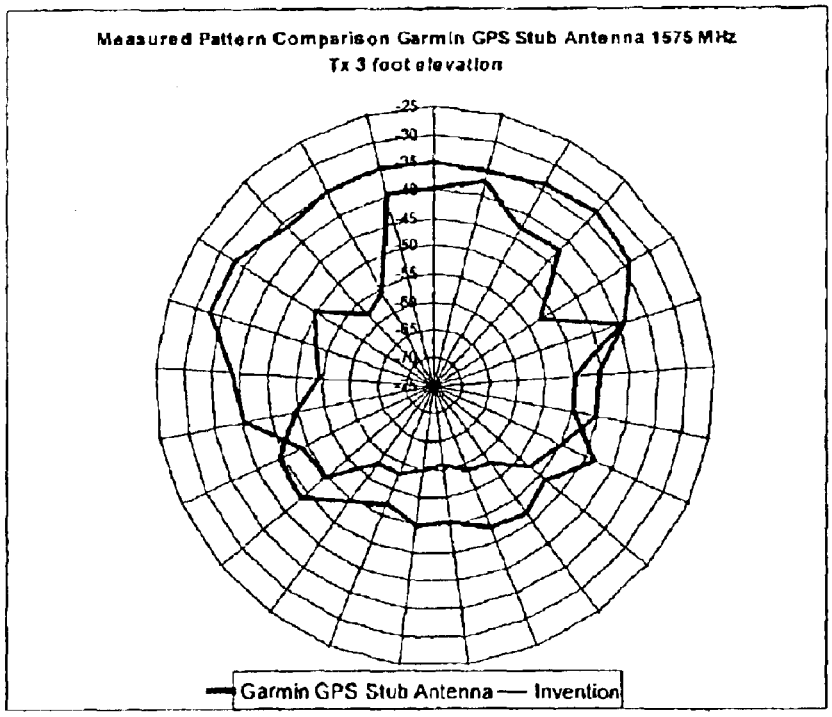
FIG 19 Data Comparison at 1575 MHz

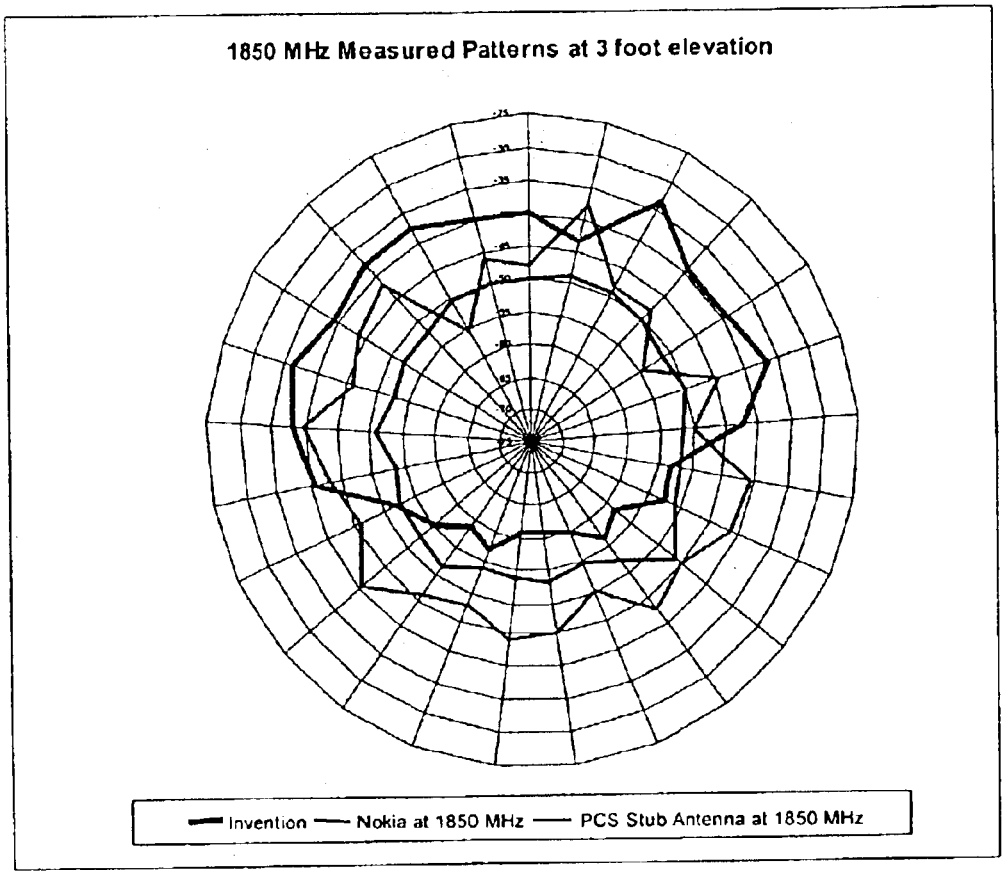
FIG 20 Data Comparison at 1850 MHz
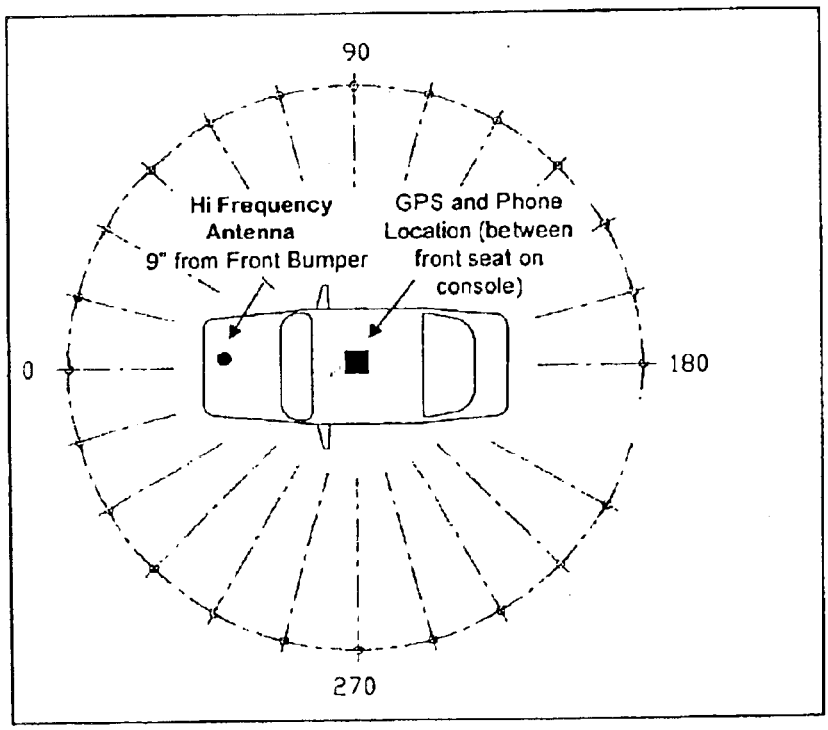
FIG 21 Test Range Setup

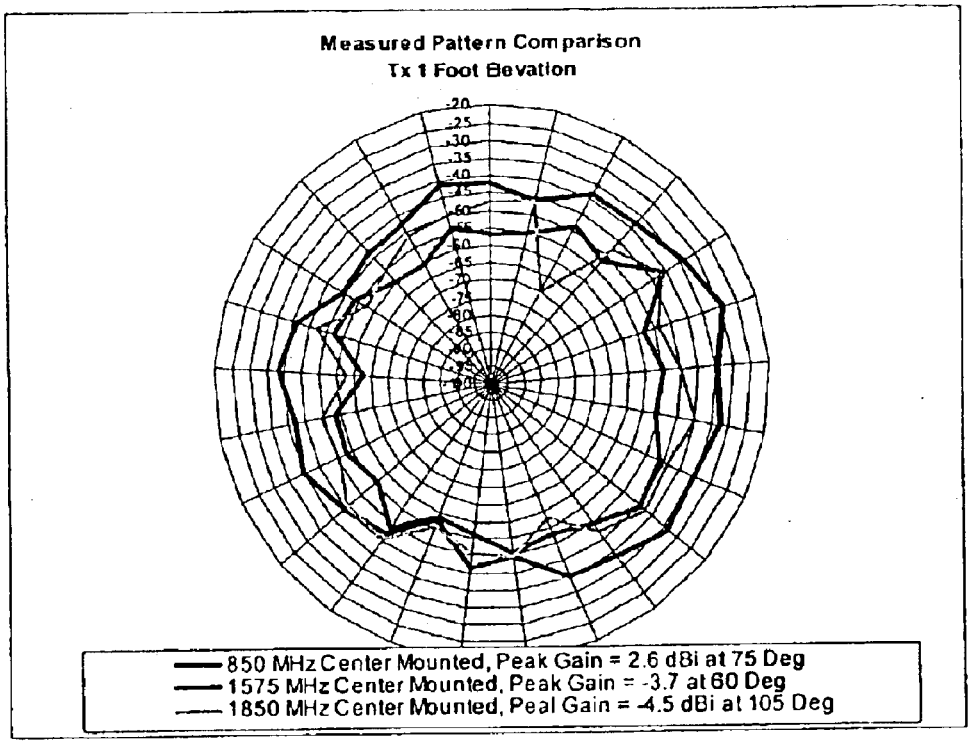
FIG 22 Patterns and Absolute Gain
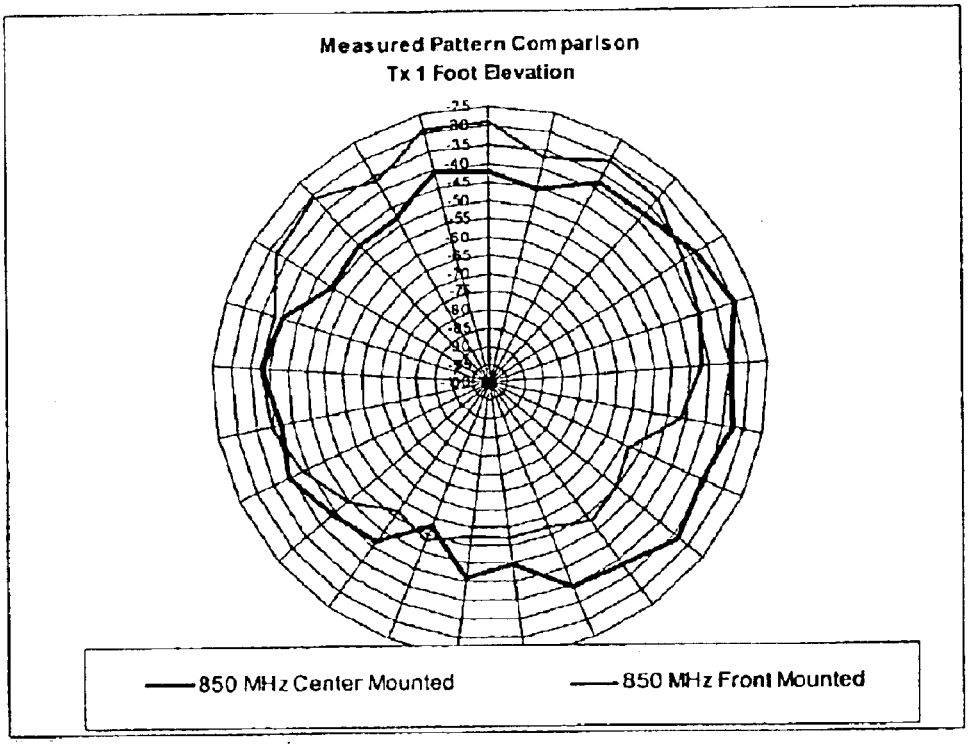
FIG 23 Comparison of Antenna Location at 850 MHz

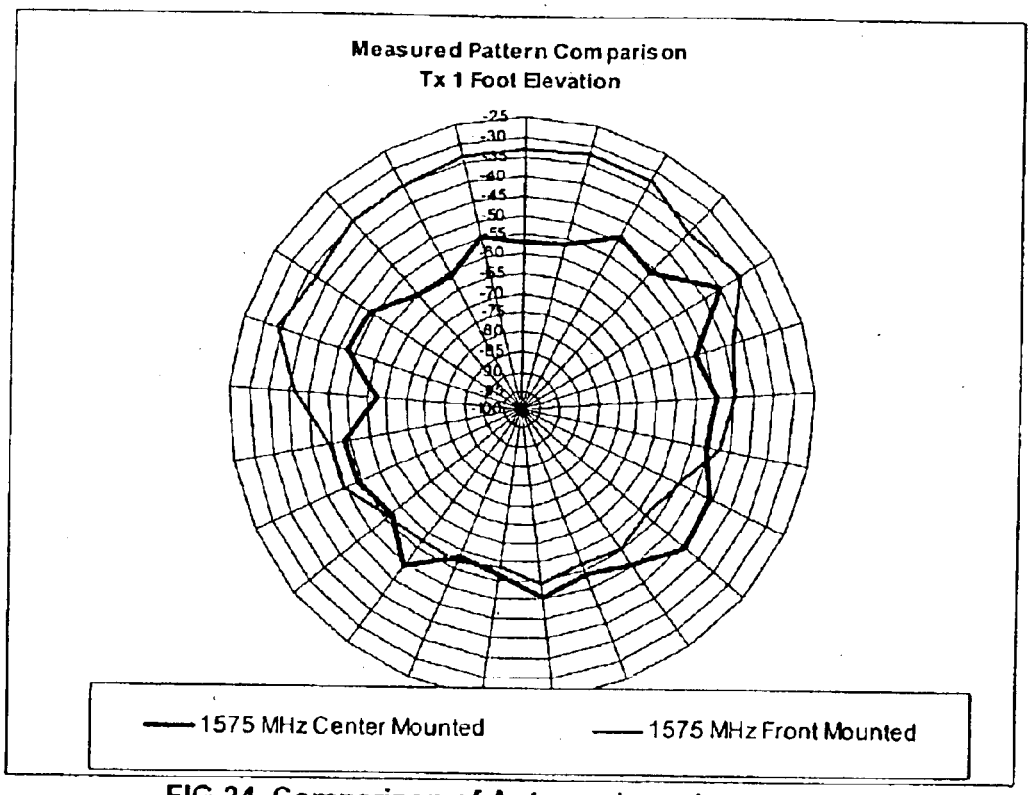
FIG 24 Comparison of Antenna Location at 1575 MHz
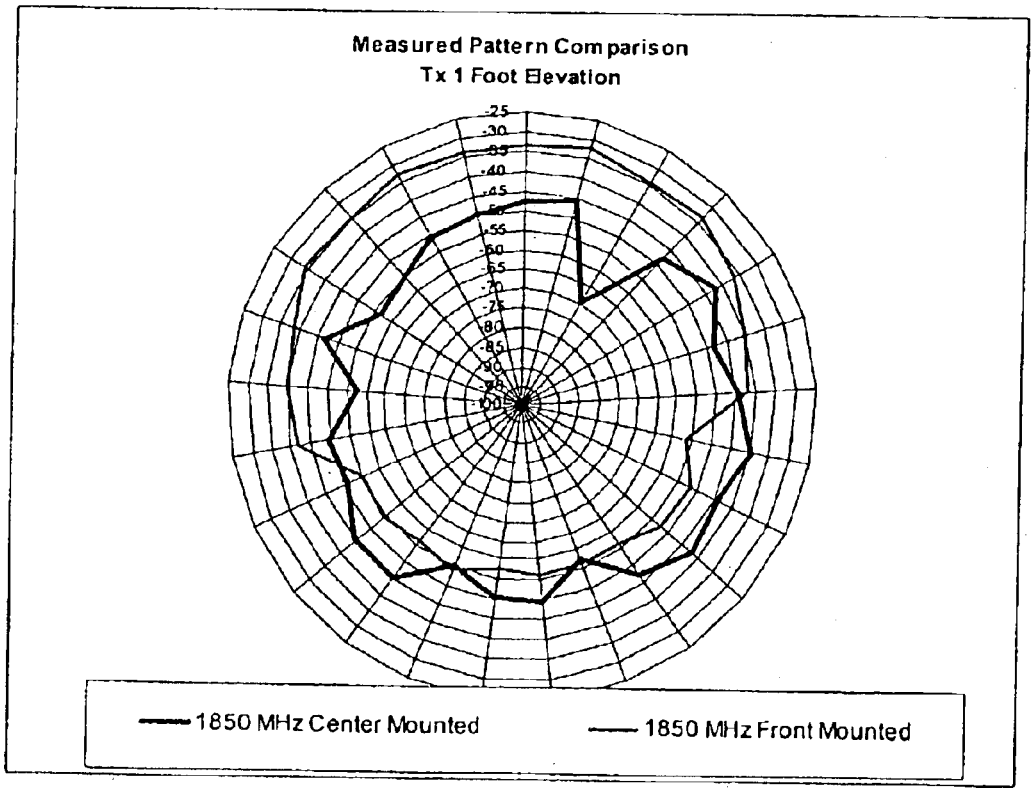
FIG 25 Comparison of Antenna Location at 1850 MHz

ANTENNA

CROSS-REFERENCE TO RELATED APPLICATIONS

This application is a continuation-in-part application of U.S. patent application Ser. No. 09/724,535, entitled "In-Vehicle Exciter", to Chadwick, filed on Nov. 27, 2000 now abandoned, and U.S. patent application Ser. No. 10/160,747, entitled "Exciter System and Excitation Methods for Communications Within and Very Near to Vehicles", to Chadwick, et al., filed on May 30, 2002 now U.S. Pat. No. 6,600,896, and the specifications thereof are incorporated herein by reference.

BACKGROUND OF THE INVENTION

1. Field of the Invention (Technical Field)

The present invention relates to an antenna and exciter systems for vehicles, such as automobiles, trucks, trains, buses, boats and aircraft.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

The automobile manufacturing industry is undergoing an industry wide revolution to provide connectivity to automobiles. This field of endeavor has been coined as "telematics" by the automotive industry. Connectivity is required for AM/FM radio, cellular, GPS, internet and satellite linkage. The first phase of this revolution has already begun. All high-end model automobiles, such as those produced by Chrysler, Daimler-Benz and Cadillac, have already eliminated external antennas on the top side of their vehicles. These antennas have been moved to the front and rear windows of the automobile. Many automobiles will be so equipped in the next several years.

Now that automobile connectivity is often used for emergency services, the survival of the antennas becomes a paramount issue. Unfortunately, one of the first things to be destroyed is the windows along with their antennas. In a severe accident, the automobile may often be upside down with the under-chassis pointed skyward. The telematics systems must be able to function even in this case.

The problem of providing a solution for a survivable antenna connectivity for vehicles has presented a major challenge to engineers and technicians in the automotive industry. The development of methods and apparatus that would supply a survivable antenna for vehicles would constitute a major technological advance, and would satisfy a long felt need within the automobile industry.

Several patents disclose an under-vehicle antenna. These include U.S. Pat. No. 2,111,398, entitled "Antenna Device" to Kippenberg; U.S. Pat. No. 2,073,336, entitled "Radio Ground Exciter" to Cook; and U.S. Pat. No. 4,968,984, entitled "Antenna Unit for a Vehicle" to Katoh, et al. None of these patents disclose the use of a discone-type of exciter.

Prior art discones do not have a coaxial cable extending through the cone portion. U.S. patent application Ser. No. 10/160,747, entitled "Exciter System and Excitation Methods for Communications Within and Very Near to Vehicles," and U.S. patent application Ser. No. 635,402, entitled "In-Vehicle Exciter", which are incorporated herein by reference, disclose a modified discone exciter, which is used for communications within a vehicle. The present invention is directed to a modified discone exciter, with a coaxial cable disposed in the cone, for communications outside the vehicle.

BRIEF SUMMARY OF THE INVENTION

The present invention relates to discone-type of antenna. This antenna comprises a disc; a cone comprising an apex and a base comprising a diameter, the disc positioned at the apex of the cone; and a coaxial cable disposed in an interior of the cone from the apex through the cone and extending outwardly beyond the cone. The antenna further preferably comprises an insulator disposed between the disc and the cone. Preferably, a coaxial cable is disposed through a center of the diameter of the cone.

The antenna may be disposed on an exterior of the vehicle, and preferably disposed under the exterior of the vehicle. Alternatively, the antenna may be disposed in an interior of a vehicle, or in a structure. The antenna preferably operates at a frequency in the range of between approximately 500 kHz and approximately 8 GHz.

The present invention is also directed to an exciter system for a vehicle. This system comprises an antenna disposed on or in a vehicle. The exciter system radiating exterior to the vehicle. The exciter system operates in at least three modes. These three modes comprise the following: (1) the antenna radiates at a higher frequency; (2) the vehicle radiates at a lower frequency; and (3) both the antenna and the vehicle radiate at a transition frequency between the lower frequency and the higher frequency.

The antenna preferably comprises a discone antenna. This discone antenna preferably comprises the discone antenna discussed above.

When the antenna is disposed under a vehicle, it is preferably disposed near a centerline of the vehicle, and most preferably disposed between approximately one and two feet of a front or rear of a vehicle (e.g. the front or rear bumper).

The lower frequency is determined by the size of the vehicle. The higher frequency is determined by the size of the discone. The cone angle is preferably between approximately 45 degrees and approximately 90 degrees. The cone height is preferably between approximately 0.4 inches and approximately 4 inches. The cable is preferably between approximately 0.08 inches and approximately 0.25 inches. The disk diameter is preferably at least 0.18 wavelengths in diameter at its lower operating frequency.

The present invention also relates to a method of excitation for sending and receiving various frequencies to and from a vehicle. This method comprises: disposing an antenna on or in a vehicle; exciting the antenna at higher frequencies that radiate outside of the vehicle; exciting the vehicle at lower frequencies that radiate outside the vehicle; and exciting both the antenna and the vehicle at transition frequencies that radiate outside the vehicle. A discone antenna, as discussed above, is preferably utilized.

The present invention provides methods and apparatuses for providing an antenna or exciter system for vehicles. In the preferred embodiment, the antenna is a modified discone exciter. Also, in the preferred another embodiment of the invention, the invention comprises an exciter mounted on the underside of the vehicle. A signal is elicited from the exciter, and may be fed to a wide variety of radio or other frequency devices onboard the vehicle.

A primary object of the present invention is to provide an antenna that has a low profile in a vehicle.

It is another object of the present invention to provide an antenna that may be mounted under a vehicle.

Yet another object of the present invention is to provide an antenna that modifies a traditional discone-type of exciter.

A primary advantage of the present invention is that a low-cost, low-profile, effective antenna is provided.

Another advantage of the present invention is that the vehicle may be used as a direct radiator for the antenna.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIGS. 7–11 show azimuth and elevation patterns at varying frequencies;

FIG. 12 is the measured return loss for various frequencies;

FIG. 13 is the measured VSWR (Voltage Standing Wave Ratio) for various frequencies;

FIGS. 14–20 show data comparison at various frequencies;

FIG. 21 shows a test range setup;

FIG. 22 shows patterns and absolute gain; and

FIGS. 23–25 show comparisons of the antenna location at various frequencies.

DETAILED DESCRIPTION OF THE INVENTION

Figure 1:
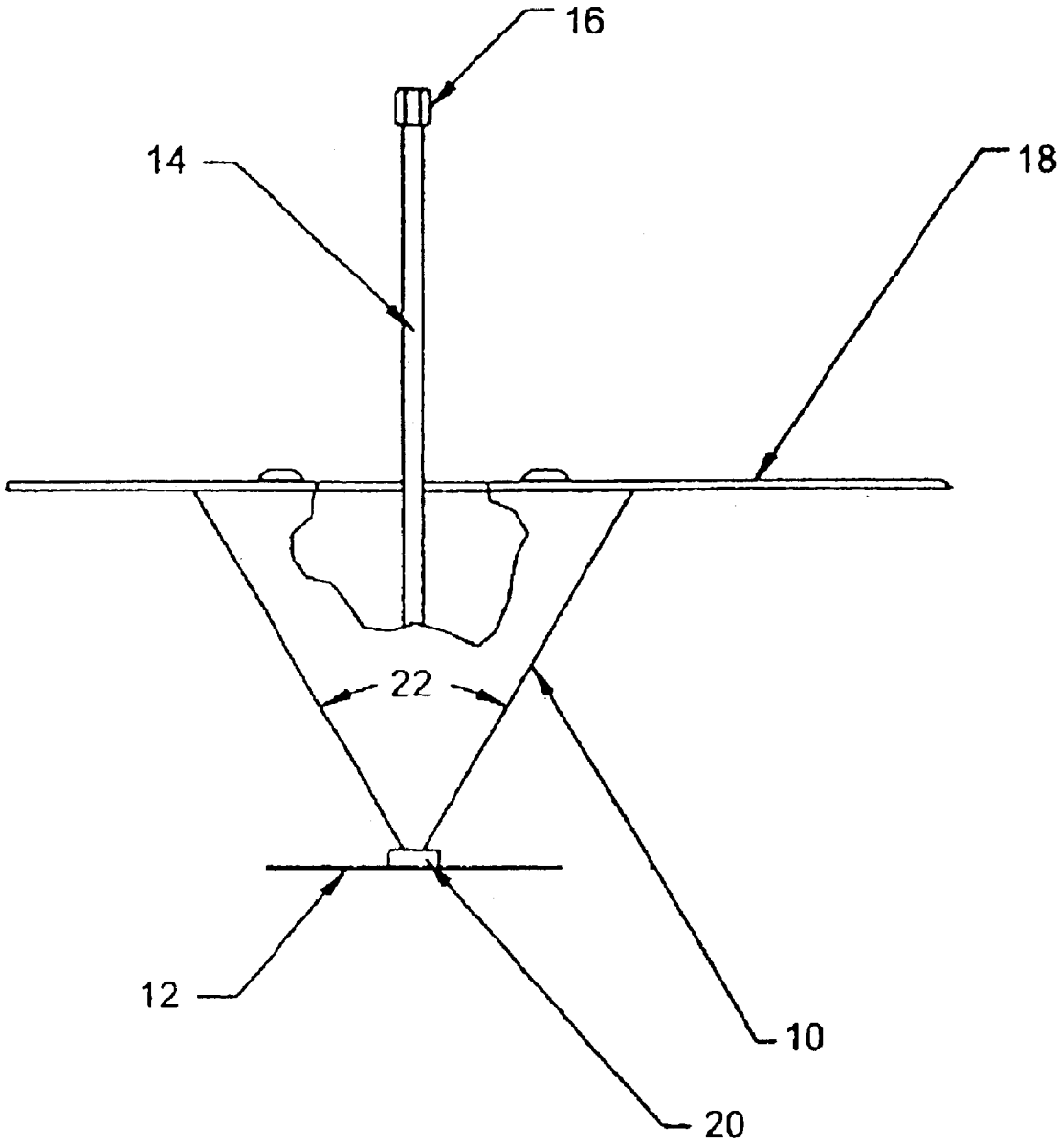
FIG. 1 is a side section view of the preferred embodiment of the present invention, showing a modified discone exciter.

The present invention is directed to antenna systems, particularly for use on vehicles, such as automobiles, trucks, trains, buses, boats, aircraft, and the like. The antenna operates at particular frequencies, such that at high frequencies, the antenna radiates and at lower frequencies, there is a transition so that the vehicle, itself, radiates. The preferred type of antenna, useful in the present invention, is a discone-type of antenna.

The terms "antenna" and "exciter" are used interchangeably throughout the specification and claims and are intended to mean a system for sending and receiving electromagnetic waves and to generate or produce an electric field. The term "discone" is intended to mean a particular type of antenna or exciter, having disc and cone components, and this term is also intended to cover "disc-cone" or other such exciters having this configuration. Although the invention is discussed as to a single antenna or exciter, multiple exciters may be utilized in or on a single vehicle.

The antenna of the present invention is particularly useful for vehicles. In vehicles, there are three modes of operation: the antenna serving as the exciter; the vehicle serving as the exciter; and a transition between the antenna and vehicle, both as exciters. At higher frequencies, when the size of the vehicle is large, the discone assembly is the major component that radiates. At lower frequencies, the vehicle itself radiates. Both the vehicle and antenna radiate at transition frequencies. Frequencies over all these ranges vary from between approximately 500 KHz to 8 GHz.

The frequencies in each of the ranges depend highly on the size of the vehicle. Three examples are given below, one for an automobile, one for a train and one for an airplane, using the following formula:

$$\text{Wavelength}=11.8/\text{frequency}.$$

Where f is in GHz, 11.8 is a constant for the speed of light, i.e. if f=1 GHz, then the above wavelength is 11.8".

Assume the car is 20 feet long. Its first resonance will occur where this dimension is ¼ (preferred) wavelength. Thus, the first resonant frequency, using the above formula, is 12.3 MHz (11.8/240 inches×1000×¼). This frequency sets the low end of the intermediate or transition band. And, thus, the intermediate band begins at approximately 12.3 MHz.

If there is a metal railroad car which is 50 feet long, then the first resonant frequency, using the above formula, is 4.9 MHz.

For an airplane, 100 feet long, the first resonant frequency, using the above formula, is 2.5 MHz.

As can be seen by the above, the frequency ranges are highly dependent on the length of the vehicle. Structure and antenna size also affect the frequencies.

The upper range of frequencies is generally set at less than or equal to ⅛ wavelength, although a range of between approximately 1/16 and ¼ wavelength is useful in accordance with the present invention. The size of the discone or antenna also determines this range. For a discone, it is useful to have the top plate at approximately 0.7 diameter of the base diameter.

The lower range is set by the size of the vehicle.

The intermediate or transition range is between the upper and lower ranges.

The antenna principally serves as a transition from itself to the vehicle and the antenna then acts as a direct radiator working against the vehicle skin (as with a ground plane). The antenna preferably has a bandwidth of approximately 100 to 1 or up to approximately 200 to 1.

The antenna is preferably mounted outside the vehicle, and most preferably on the underside of the vehicle in order to minimize damage in the event of a crash. However, the antenna may be mounted at any place inside or outside the vehicle, preferably at a location that avoids interference with other functions of the vehicle or prevents interference with the antenna. For instance, it could be positioned on the back or front window ledges, near the bumper, etc. The antenna is capable of sending and receiving frequencies to and from outside the vehicle due to the particular frequencies.

The transition frequency from one mode to the other is a vehicle size and configuration variable. The lowest limit occurs where the size of the vehicle is approximately a quarter wavelength long and the match is good. Below the lower limit the match gradually degrades to a poorer and poorer value because the automobile is becoming smaller than the wavelengths. Above the lower limit region the loss is approximately 50% until the mode of operation where the antenna begins to act as a near independent radiator. The independent mode can be very match efficient.

In the low frequency region the match is poorest but the long wavelengths have less propagation loss and thus the match loss is generally acceptable. In the region above 60 MHz the 50% match loss can be reduced over limited bands by the use of diplexers and matching elements. In the upper region, the match is quite good (preferably from 800 MHz to 2 GHz).

The frequency zones are defined but radiation characteristics must be quantified. For frequencies about 60 MHz the radiation shape is that of a cardiod, being near omnidirectional in azimuth and similar to that of a monopole over a ground plane in elevation. As the frequency increases, the pattern is overall the same but with more fine structural detail as the frequency approaches 800 MHz. In the region from 800 MHz to 8.0 GHz the patterns are much like the low end except for automobile induced blockage effects.

The characteristics of the antenna, when applied to larger trucks and vans differ in details from those above described for an automobile. The characteristics referred to are those of match, patterns and gain. The performance from 800 MHz to 2.0 GHz (preferred range) is the same as in an automobile except for blockage detail. The intermediate range is now dependent on the size of the truck or van, but will generally be lower in frequency. The first resonant frequency will generally be below 60 MHz because the truck is larger.

FIG. 1 is a depiction of the preferred discone antenna of the present invention. As shown therein, discone antenna comprises cone 10 (preferably a solid cone), disc 12, coaxial cable 14 which extends through cone to disc, cable connector 16, ground plane (e.g. undercarriage of automobile) 18, and preferably insulating spacer 20.

Coaxial cable 14 is connected to devices in the vehicle that receive or transmit various frequencies to or from outside the vehicle. These include AM/FM radio, GPS, cellular, internet, satellite linkage, garage door, gate and other outside devices, traffic control, roadside antenna, vehicle identification, video transfer, light and other electronics control, and the like. Wireless connections may also be utilized in accordance with the present invention.

The antenna of the present invention incorporates the vehicle (at low frequencies). This antenna is preferably located within one to two feet of the front bumper of the vehicle (e.g. automobile or truck) and near the centerline of the vehicle. The dimensions are selected to keep the match and pattern shapes acceptable. Cone angle 22 is preferably approximately 60 degrees but can vary between approximate 45 degrees and approximately 90 degrees. Cone height is preferably between approximately 0.5 inches and approximately 12 inches, preferably between approximately one and approximately four inches and most preferably between approximately two and approximately three inches (e.g. 2.84 inches). Coaxial cable 14 diameter is preferably between approximately 0.1 inches and approximately 0.2 inches (e.g. 0.141 inch diameter). Disc 13 diameter is at least 0.18 (e.g. 0.18 to 0.5 wavelengths) wavelengths in diameter at the lowest operating frequency (see FIG. 1).

When the discone is attached to the undersurface of the vehicle, disc 12 is positioned at the lowest level of cone 10. Ground plane 18 is intended to attach to the underside of the vehicle after validation is first obtained on the free space range.

Figure 2:
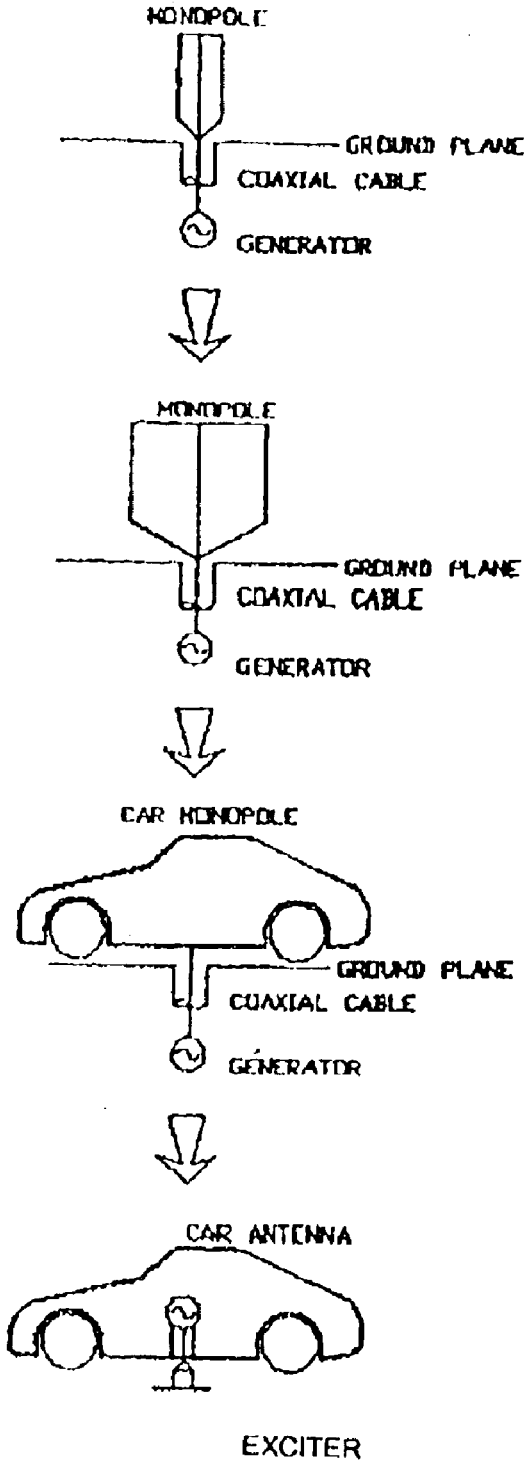
FIG. 2 is a diagram of the evolution of the present invention.

FIG. 2 pictorially describes the evolution of one embodiment of the present invention. The top figure shows a conventional monopole excited by a coaxial cable which connects to a signal source (e.g., a generator). The monopole is typically ¼ wavelength long, and the ground plane is preferably greater than ½ wavelength in diameter. In the next stage of the evolution, a fatter monopole provides greater bandwidth. There is no particular shape requirements imposed on the monopole for most frequencies, and so the monopole may be replaced by the automobile itself. The third evolution shows an automobile acting as the monopole driven against a ground plane.

In the final stage of evolution the generator is moved interior to the automobile, giving rise to the present invention. The preferred embodiment of the present invention is characterized by being significantly less that ½ wavelength. One of the prime functions of the present invention is to serve as an exciter for a vehicle such as an automobile. In this case, the automobile becomes the antenna, just as the monopole in the first case was the antenna.

The present invention then acts as an exciter which causes the automobile itself to be a radiator. It has been shown that this invention is usable from 500 kHz to 8 GHz.

Figure 3A:
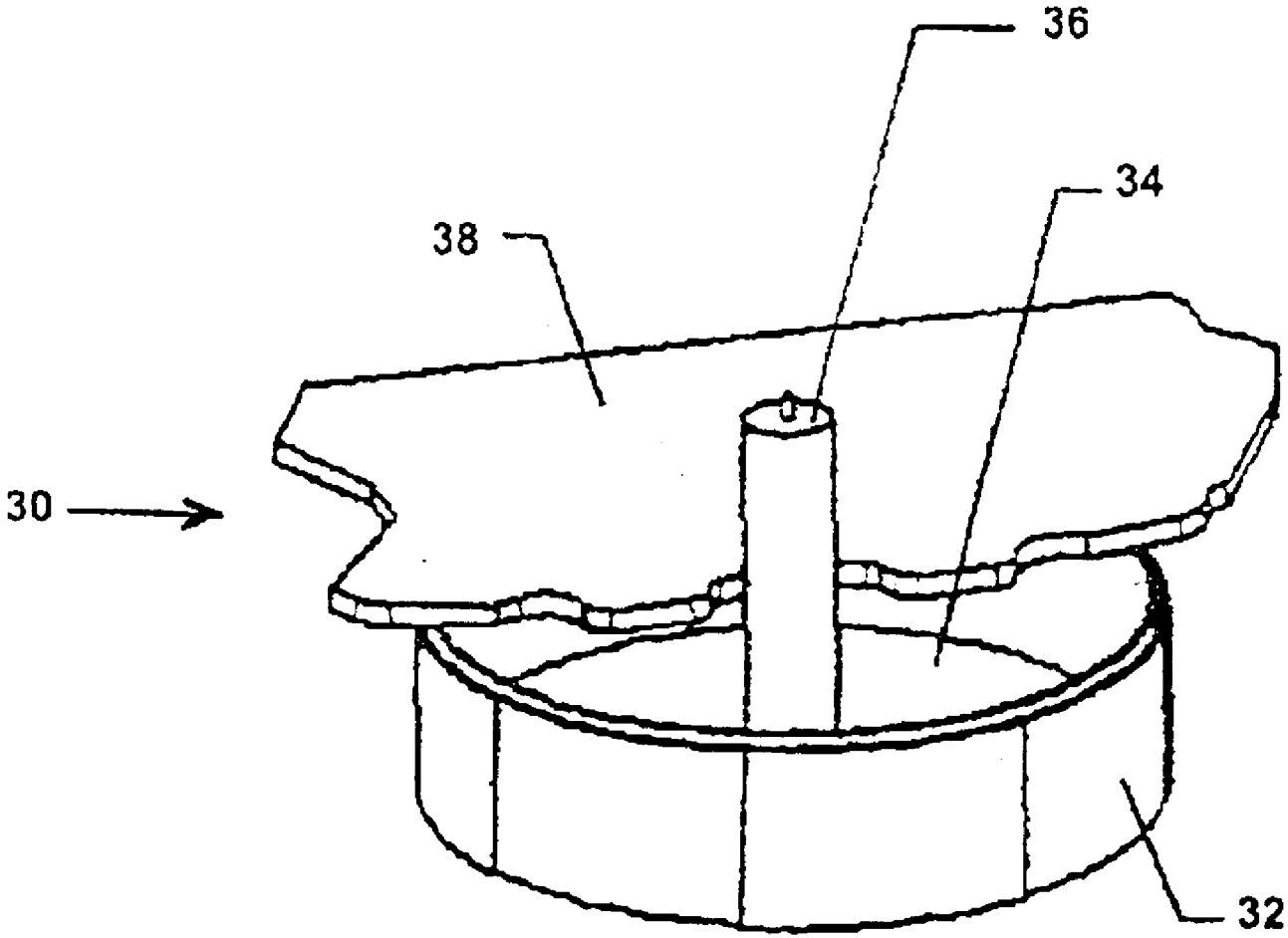
FIG. 3A is a perspective cutaway view of an embodiment of the present invention intended for AM/FM radio applications.
Figure 3B:
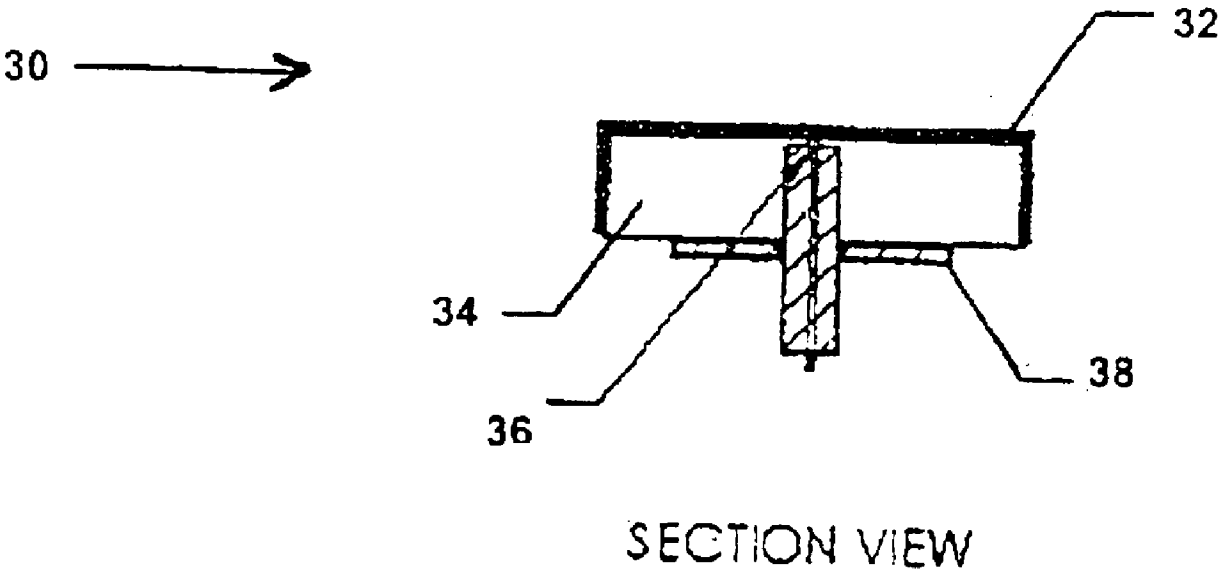
FIG. 3B is a section view of the FIG. 3A embodiment.

FIGS. 3A and 3B illustrate an alternative embodiment of the invention, which is designed for AM/FM radio applications. Antenna 30 is preferably 8" in diameter and 1.5" in depth, but can be other dimensions based on the vehicle and intended application. Top metallic cover 34 is enclosed by choke 32, which minimizes direct radiation from the invention. Coaxial tube 36 (e.g. 1" diameter) connects to the top cover at its underside. The invention is preferably mounted in the central area of the under chassis 38 of the automobile.

Figure 4:
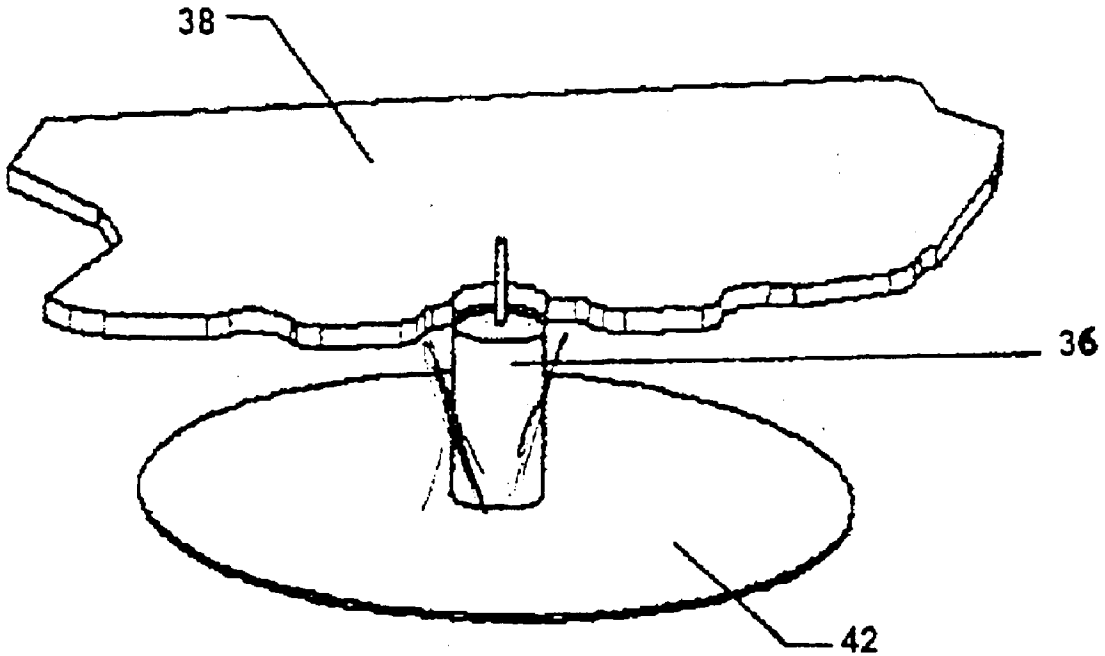
FIG. 4 is a perspective cutaway view of another embodiment of the present invention.

FIG. 4 illustrates another embodiment of the present invention. This embodiment offers improved radiation resistance, and is preferably mounted in the center of under chassis 38 of the automobile. In this embodiment, coaxial center conductor 36 excites a rod (e.g. 1" diameter and 1.5" in length). The rod is surrounded by a plate or disc (e.g. 8" diameter) which serves as an exciter 42. This antenna may be used to receive AM/FM radio and GPS. It may also be used to provide connectivity to a low Earth orbit satellite system in the 137 to 150 MHz region.

Figure 5:
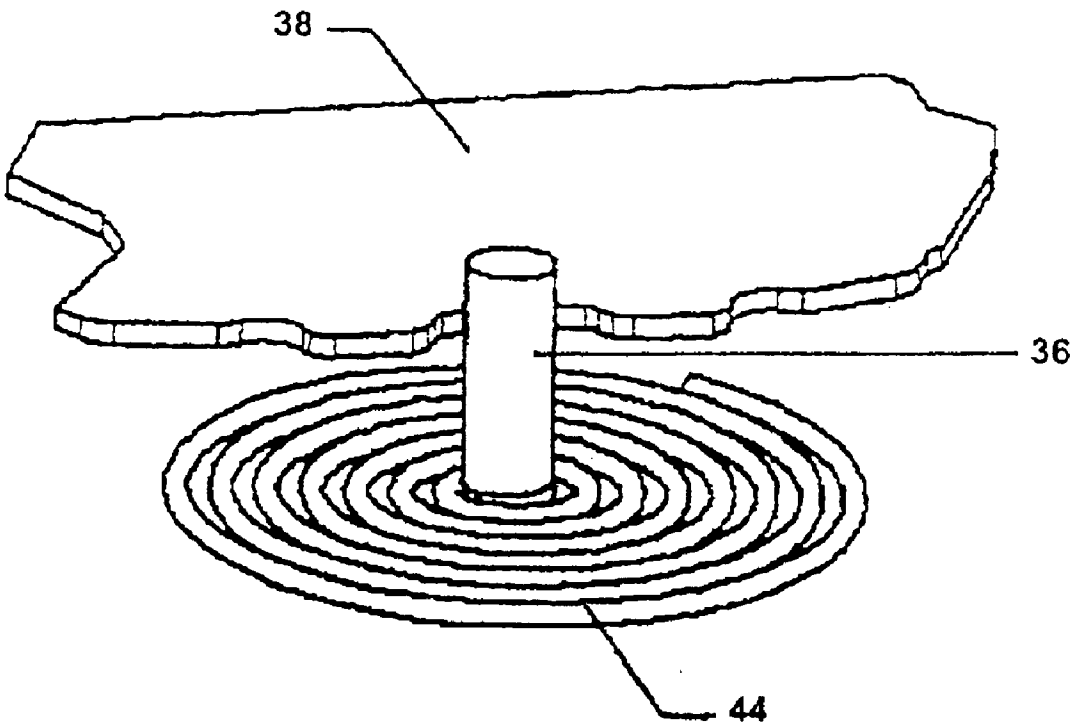
FIG. 5 is a perspective cutaway view of a spiral embodiment of the present invention.

FIG. 5 illustrates a third embodiment of the present invention with the disc replaced by a conductive coil 44 (e.g. 8" diameter metal plate). This antenna is designed to exhibit the best bandwidth and radiation resistance characteristics. This embodiment may be used to achieve the same connectivity as the invention shown in FIG. 4, but with improved signal level. The inventions shown act as an exciter for exciting the automobile.

All these inventions may achieve connectivity even when the car is upside down (i.e, with the exciter pointing skyward).

INDUSTRIAL APPLICABILITY

The invention is further illustrated by the following non-limiting examples.

EXAMPLE 1

Figure 6:
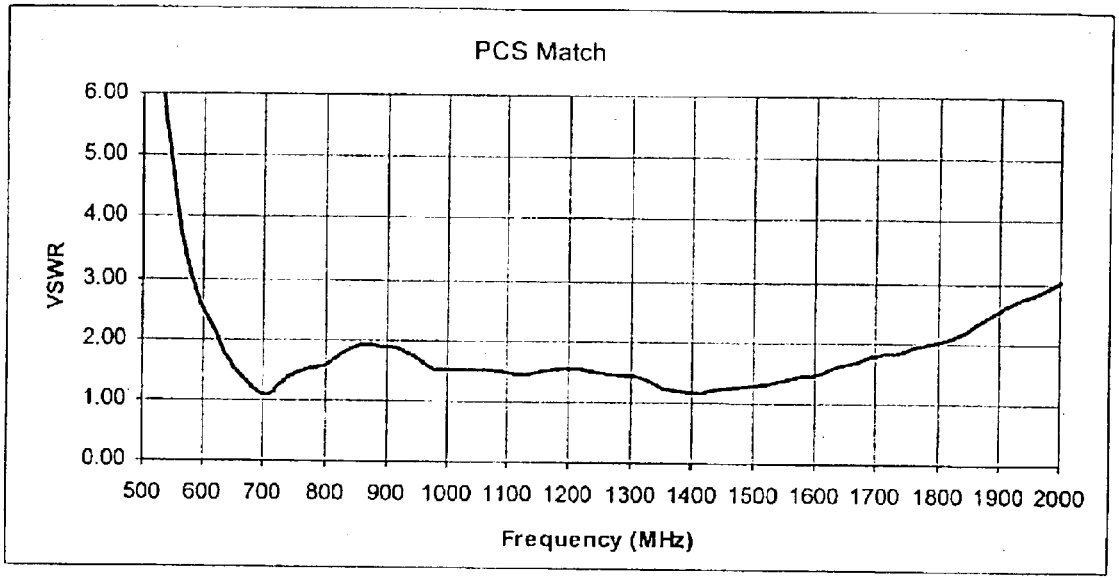
FIG. 6 is a graph of VSWR (Voltage Standing Wave Ratio) versus frequency for a PCS match.

Initial data was first taken on a free space range and included the ground plane shown in FIG. 1. The match of the antenna is shown in FIG. 6. The Voltage Standing Wave Ratio (VSWR) is less than 2:1 from 600 MHz to 1800 MHz. The VSWR is less than 3:1 from 580 MHz to 2 GHz. The azimuth and elevation patterns are shown in FIGS. of 7 through 11. The azimuth patterns are omnidirectional with 1 dB from 800 MHZ to 1.5 GHz and less than 2 dB to 1.9 GHz. The elevation patterns are typical cardiods over the entire band. The 0 degree reference was at the base of the ground plane. The results were considered adequate and the next phase was the testing of an automobile mounted antenna.

EXAMPLE 2

The FIG. 1 antenna was positioned 9" from the centerline of the front bumper of an automobile. The measured return loss is shown in FIG. 14 and measured VSWR is shown in FIG. 13. The VSWR is less than 3 to 1 from approximately 620 MHz to 2 GHz. The effect of VSWR on the vehicle is quite small as shown in the comparison of FIG. 6.

Measured patterns are shown in FIGS. 14 through 16 for frequencies of 850 MHz, 1575 MHz and 1850 MHz and at elevation heights of 1, 3 and 5 feet (the transmitter was located approximately 10 feet away from the vehicle). The 850 MHz frequency generally provided the same response, however, the front lobe was typically 20 dB stronger than the rear lobe. The 1575 MHz frequency provided better coverage for heights of 1–3 feet above the ground and 10 feet away, but was reduced at an elevation of 5 feet. At 1575 MHz the front lobe was typically 20 dB stronger than the rear lobe. At 1850 MHz the front lobe was typically 20 dB stronger than the rear lobe and the pattern levels reduced slightly above 3 feet. The gain values are shown in FIG. 17 for all three frequencies. The absolute gains are measured in the forward 0 degree direction and are 5.4, 4.5, and −3.3 dBi. The gains were typically greater than a dipole in the forward direction, largely because the back lobe in all cases was approximately 20 dB lower. The gain data were obtained by the substitution method.

EXAMPLE 3

The relative gains of an analog cell phone stub antenna, GPS stub antenna and PCS stub antenna are shown in FIGS. 18 through 20 compared with the antenna of the present invention. The antenna of the present invention was stronger over most of the region except for the rearward direction. The stub antennas for each unit were located on the console between the driver and passenger seats. The stub antennas were mounted vertically to match the testing antenna polarization. The test range layout is shown in FIG. 21.

EXAMPLE 4

GPS test data were taken on the stub antenna of the present invention during actual driving conditions from Santa Clara to Lodi, Calif., a 215 mile round trip. The average accuracy was 22 feet and compared well with the stub which provided accuracy from 20 to 26 feet at DRG. On average there were 6 to 10 satellites in view during the trip taken. The 22 foot accuracy was maintained through the foothill passes. The unit had readings as low as 16 feet and as high as 50 feet. The average duration of greater than 30 feet was 2 seconds. The most common accuracy was 18 feet. The satellites with the stronger signal strength were generally located overhead and forward, while those located to the rear and low horizon had the lower signal strength.

Both an analog and PCS phone were used to make connections. The measured signal strength on the phone indicators for both the antenna of the present invention and the manufacturers' stub antennas were the same. The quality of the phone receptions appeared to be approximately the same.

The antenna of FIG. 1 was moved to the center of the automobile and was located under the passenger near center of the vehicle. FIG. 22 shows the patterns and the absolute gain at the three frequencies of 850, 1575 and 1850 MHz. The patterns are more symmetric than those located at the front of the vehicle. At 1850 MHz there was a significant notch at 30 degrees. FIGS. 23 through 25 show direction comparisons with the data taken when the antenna was at the front of the vehicle. The center mounted data was generally more uniform as expected. The relative gain of the center mounted antenna showed the increased interference of the vehicle undersurface.

EXAMPLE 5

The same structure used in FIG. 1 also served as an antenna for an intermediate range (50 to 800 MHz) in an automobile. In this case however, the major radiator transitioned from a body radiating device to 50 MHz to a partial body device as the frequency approached 800 MHz. The antenna design was the same except that the disk was approximately 6 inches in diameter for case 1. A 12 inch diameter disc produced far better results. The lower frequency resonance occurred in the region just below 60 MHz and had a mismatch that was generally less than 2:1 over a narrow bandwidth.

EXAMPLE 6

The VSWR and loss data when the antenna was mounted on an automobile is shown in FIG. 22. The reference point is the antenna terminal. The VSWR inflection point occurred at approximately 325 MHz for a 6 inch disk and at approximately 125 MHz for the 12 inch disk. The corresponding inflections for loss are shown in FIG. 22 for both the 6 and 12 inch disk. The improvement from 6 to 12 inches was dramatic. A 12 inch disk at 115 MHz had a 3 dB loss and at 230 MHz it had a 1 dB loss. A 6 inch disk had a 3 dB loss at 260 MHz and a 1 dB loss at 314 MHz. The approximate rule for selecting the disk diameter for a loss of 3 dB is 0.18 times the wavelength of the lowest operating frequency. The measured patterns in the azimuth plane at 1 foot elevation are shown in FIG. 23 for frequencies of 98 and 325 MHz. The pattern levels shown were relative. The patterns were taken with a disk diameter of 12 inches. The peak gain at 98 MHz was −4.8 dBi including match losses (4.3 dB) in the antenna. The peak gain at 325 MhZ was −6.0 dBi including match losses (1.5 dB) in the antenna. No pattern data was taken on the 6 inch disk. Absolute gains were obtained with a gain standard. The application of simple matching using a transformer and an inductor provided a maximum loss of 1.4 dB over the region from 86 MHz to 110 MHz using a 12 inch disk. This matching increased the gain from the earlier noted −4.8 dBi to −1.8 dBi. A 12 inch disk was used to receive FM signals over the full FM band. The results were compared with a standard automobile whip antenna. There was no discernable difference between the antenna with a 12 inch disk and the whip antenna.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An exciter system for a vehicle comprising:

a discone antenna disposed on or in a vehicle;

said exciter system operating in at least three modes comprising:

said discone antenna radiating at a higher frequency;

the vehicle radiating at a lower frequency; and both said discone antenna and the vehicle radiating at a transition frequency between said lower frequency and said higher frequency.

2. The exciter system of claim 1 comprising a discone antenna operating in the signal frequency range between 500 KHz and 8 GHz.

3. The exciter system of claim 1 wherein said discone antenna comprises:

a disc;

a cone having an apex and a base; and said disc positioned adjacent said apex of said cone.

4. The exciter system of claim 3 wherein said cone has an angle between approximately 45 degrees and approximately 90 degrees.

5. The exciter system of claim 3 wherein said cone has a height between approximately 0.4 inches and approximately 4 inches.

6. The exciter system of claim 3 wherein said cone has a disc diameter is at least 0.18 wavelengths of its lower operating frequency.

7. The exciter system of claim 3, additionally including a coaxial cable disposed within said cone.

8. The exciter system of claim 7 wherein said coaxial cable has a diameter of between approximately 0.08 inches and approximately 0.25 inches.

9. The exciter system of claim 3 additionally comprising an insulator disposed between said cone and said disc.

10. The exciter system of claim 1 wherein said antenna is disposed within the interior of the vehicle.

11. The exciter system of claim 1 wherein said antenna is disposed on the exterior of the vehicle.

12. The exciter system of claim 11 wherein said antenna is disposed on a bottom surface of the vehicle.

13. The exciter system of claim 11 wherein said antenna is disposed near a centerline of the vehicle.

14. The exciter system of claim 11 wherein said antenna is mounted approximately one and two feet of a front of a vehicle.

15. The exciter system of claim 14 wherein said antenna is mounted between approximately one and two feet of a front bumper.

16. The exciter system of claim 1 wherein said lower frequency is determined by the size of the vehicle.

17. The exciter system of claim 1 wherein said higher frequency is determined by the size of said discone.

18. A method of excitation for sending and receiving signals at various frequencies to and from a vehicle, the method comprising the steps of:

disposing a discone antenna on or in a vehicle;

exciting the discone antenna at higher signal frequencies;

exciting the vehicle at lower signal frequencies; and exciting both the discone antenna and the vehicle at transition frequencies.

19. An exciter system for a vehicle comprising:

a discone antenna disposed on or in a vehicle;

the vehicle having a metallic body;

said exciter system operating in at least three modes said three modes comprising:

said discone antenna radiating at a higher frequency;

said vehicle metallic body radiating at a lower frequency; and both said antenna and the vehicle metallic body radiating at a transition frequency between said lower frequency and said higher frequency.

20. The exciter system of claim 19 wherein said discone antenna comprises:

a disc;

a cone having an apex and a base;

said disc positioned adjacent said apex of said cone.

21. The exciter system of claim 20 additionally including a coaxial cable disposed within said cone.

22. The exciter system of claim 20 additionally comprising an insulator disposed between said cone and said disc.

23. The exciter system of claim 20 wherein said cone angle is between approximately 45 degrees and approximately 90 degrees.

24. The exciter system of claim 20 wherein said cone has a height of between approximately 0.4 inches and approximately 4 inches.

25. The exciter system of claim 20 wherein said coaxial cable has a diameter of between approximately 0.08 inches and approximately 0.25 inches.

26. The exciter system of claim 20 wherein said disc diameter is at least 0.18 wavelengths of its lower operating frequency.

27. The exciter system of claim 19 wherein said antenna is disposed within the interior of the vehicle.

28. The exciter system of claim 19 wherein said antenna is disposed on the exterior of the vehicle.

29. The exciter system of claim 19 wherein said antenna is disposed on a bottom surface under the exterior of the vehicle.

30. The exciter system of claim 19 wherein said antenna is disposed near a centerline of the vehicle.

31. The exciter system of claim 30 wherein said antenna is disposed within approximately two feet of a front of a vehicle.

32. The exciter system of claim 31 wherein said antenna is disposed within between approximately one and two feet of a front bumper.

33. The exciter system of claim 19 wherein said lower frequency is determined by the size of the vehicle, metallic body.

34. The exciter system of claim 19 wherein said higher frequency is determined by the size of said discone.

* * * * *